US005529021A

United States Patent [19]

Butterlin et al.

[11] Patent Number: 5,529,021

[45] Date of Patent: Jun. 25, 1996

[54] FORCED ONCE-THROUGH STEAM GENERATOR

[75] Inventors: Axel Butterlin, Eckersdorf; Hermann Dörr, Herzogenaurach; Joachim Franke, Altdorf, all of Germany

[73] Assignee: Siemens Aktiengesellschaft, Munich, Germany

[21] Appl. No.: 334,421

[22] Filed: Nov. 4, 1994

[30] Foreign Application Priority Data

May 4, 1992 [EP] European Pat. Off. ..... 92107500
May 27, 1992 [DE] Germany ..... 42 17626.3

[51] Int. Cl.[6] ..... F22B 37/42

[52] U.S. Cl. ..... 122/448.1; 122/448.4

[58] Field of Search ..... 122/448.1, 448.2, 122/448.3, 448.4, 446, 447

[56] References Cited

FOREIGN PATENT DOCUMENTS

| | | |
|---|---|---|
| 0439765 | 1/1990 | European Pat. Off. . |
| 2133672 | 12/1972 | France . |
| 2118028 | 3/1973 | Germany . |
| 3242968 | 1/1984 | Germany . |

OTHER PUBLICATIONS

VGB Kraftwerkstechnik 65, No. 1, Jan. 1985, pp. 25–33 (Lausterer et al.) "Temperature or Enthalpy as Main Control Variable for Benson Boilers";.

*Primary Examiner*—Henry A. Bennett
*Assistant Examiner*—Siddharth Ohri
*Attorney, Agent, or Firm*—Herbert L. Lerner; Laurence A. Greenberg

[57] ABSTRACT

A forced once-through steam generator with an evaporator heating surface has a control device for a furnace which is controlled by a setpoint value L assigned to the steam generator power and a control device for a feed-water mass flow $\dot{M}$ into the evaporator heating surface. In order to avoid an overshoot of a specific enthalpy at an outlet of the evaporator heating surface, a device is superimposed on the feedwater control device which serves to derive a variable $Q(L1)/,[h_{sA}(L2)-h_{iE})$ as a setpoint value $\dot{M}_s$ for the feed-water mass flow. In this case $h_{iE}$ is the specific enthalpy at an inlet of the evaporator heating surface, Q(L1) is a value derived by a first power value L1 from a function generator for a heat flow into the evaporator heating surface and $h_{sA}(L2)$ is a setpoint value derived by a second power value L2 from the function generator for the specific enthalpy at the outlet of the evaporator heating surface. L1 is a first power value which is delayed with respect to the setpoint value L assigned to the steam generator power, and L2 is a second power value which is delayed with respect to the first power value L1.

9 Claims, 2 Drawing Sheets

FORCED ONCE-THROUGH STEAM GENERATOR

CROSS-REFERENCE TO RELATED APPLICATION

This application is a continuation of International Application PCT/DE93/00344, filed Apr. 21, 1993.

BACKGROUND OF THE INVENTION

1. Field of the Invention

The invention relates to a forced once-through steam generator having an evaporator heating surface, a device connected upstream of the evaporator heating surface in terms of flow for setting a feed-water mass flow $\dot{M}$ into the evaporator heating surface, and a control device being assigned to the device, having a control variable being the feed-water mass flow $\dot{M}$ and having a setpoint value $\dot{M}_s$ for the feed-water mass flow being controlled as a function of a setpoint value L assigned to the steam generator power.

Such a forced once-through steam generator is disclosed in the publication entitled: "VGB Kraftwerkstechnik 65", No 1 January 1985, page 29, FIG. 6. In that known forced once-through steam generator, in order to synchronize the heat flow into the evaporator heating surface with the feed-water mass flow, the setpoint value for the feed-water mass flow is controlled by the setpoint value of the steam generator power or by a setpoint value assigned to the steam generator power, through a delay element. Other measures are not provided for that synchronization.

It has been found that in that known forced once-through steam generator, an overshoot of the specific enthalpy at the outlet of the evaporator heating surface cannot be avoided when the steam generator power changes as a consequence of load changes. Such an overshoot may not only reduce the service life of the once-through steam generator but may also hamper the control of the temperature of the live steam delivered by the once-through steam generator.

2. Summary of the Invention

It is accordingly an object of the invention to provide a forced once-through steam generator, which overcomes the hereinafore-mentioned disadvantages of the known devices of this general type and which substantially reduces or avoids completely the disadvantageous overshoot of the specific enthalpy at the outlet of the evaporator heating surface.

With the foregoing and other objects in view there is provided, in accordance with the invention, a forced once-through steam generator, comprising an evaporator heating surface having an inlet and an outlet; a device connected upstream of the evaporator heating surface in terms of flow for setting a feed-water mass flow $\dot{M}$ into the evaporator heating surface; a control device being associated with the device and having a control variable being the feed-water mass flow M and a setpoint value $\dot{M}_s$ for the feed-water mass flow being controlled as a function of a setpoint value L assigned to a steam generator power; another device associated with the control device for deriving a variable $Q(L1)/(h_{sA}(L2)-h_{iE})$ as the setpoint value $\dot{M}_s$ for the feed-water mass flow, the other device receiving an actual value $h_{iE}$ of a specific enthalpy at the inlet of the evaporator heating surface and the setpoint value L assigned to the steam generator power, as input variables; a function generator from which a value Q(L1) for a heat flow into the evaporator heating surface is derived by a first power value L1, in accordance with a function of the first power value L1 to be fixedly predetermined; a setpoint value $h_{sA}(L2)$ for a specific enthalpy at the outlet of the evaporator heating surface being derived by a second power value L2 from the function generator in accordance with a function of the second power value L2 to be fixedly predetermined; a first delay element delaying the first power value L1 relative to the setpoint value L assigned to the steam generator power; and a second delay element delaying the second power value L2 relative to the first power value L1.

The processing of the actual value of the specific enthalpy at the inlet of the evaporator heating surface makes it possible to use the heat flow flowing into the evaporator heating surface to determine the setpoint value for the feed-water mass flow, with the result that the feed-water mass flow fed to the evaporator heating surface can largely be matched to the heat flow fed to the evaporator heating surface. This permits a systematic control of the specific enthalpy at the outlet of the evaporator heating surface.

In accordance with another feature of the invention, the device for deriving the variable $\dot{Q}(L1)/(h_{sA}(L2)-h_{iE})=\dot{M}_s$ includes a differentiating element having an input being connected to the second power value L2 at the output of the second delay element or to the actual value of a pressure measured downstream of the evaporator heating surface and temporarily reducing the value of the variable derived as a setpoint value $\dot{M}_s$ by a correction value, if the second power value L2 at the output of the second delay element or of the actual value of the pressure measured downstream of the evaporator heating surface rises, and temporarily increasing it by a correction value if the second power value L2 or the actual value of the pressure measured downstream of the evaporator heating surface decreases. This allows for energy storage in the metal masses of the evaporator heating surface, with the result that the feed-water mass flow fed to the evaporator heating surface is even better matched to the heat flow being fed to the evaporator heating surface.

In accordance with a further feature of the invention, the device for deriving the variable $\dot{Q}(L1)/(h_{sA}(L2)-h_{iE})=\dot{M}_s$ includes a functional element with a differentiating characteristic, having an input being connected to the actual value $h_{iE}$ of the specific enthalpy at the inlet of the evaporator heating surface and temporarily reducing the value of the variable derived as a setpoint value $\dot{M}_s$ by a correction value if the actual value $h_{iE}$ of the specific enthalpy at the inlet of the evaporator heating surface rises and temporarily increasing it by a correction value if the actual value $h_{iE}$ decreases. This takes account of the fact that the effects of mass flow and temperature changes of the feed water entering the evaporator heating surface do not proceed synchronously in the evaporator heating surface.

In accordance with an added feature of the invention, there is provided an enthalpy correction control having a controller input for receiving the variable $(h_{sA}(L2)-h_{iA})$ as a control deviation and having a controller output for supplying a correction value being added to a difference $(h_{sA}(L2)$ $h_{iE})$, where $h_{iA}$ is the actual value of the specific enthalpy at the outlet of the evaporator heating surface.

In accordance with an additional feature of the invention, there is provided a multiplication element, the function generator including a first and a second function generator unit receiving the first power value L1 and supplying output signals $(\dot{M}(L1), \Delta h(L1)$ being fed to the multiplication element.

In accordance with yet another feature of the invention, there is provided a summing element, the function generator including a third function generator unit receiving the second power value L2 and supplying an output signal ($h_{sA}$(L2)) to be fed to the summing element.

In accordance with yet a further feature of the invention, the other device includes a dividing element for deriving the variable $\dot{M}_s$.

In accordance with a concomitant feature of the invention, there is provided a measuring device for determining the actual value of the specific enthalpy at least at one of the inlet and the outlet of the evaporator heating surface.

Other features which are considered as characteristic for the invention are set forth in the appended claims.

Although the invention is illustrated and described herein as embodied in a forced once-through steam generator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
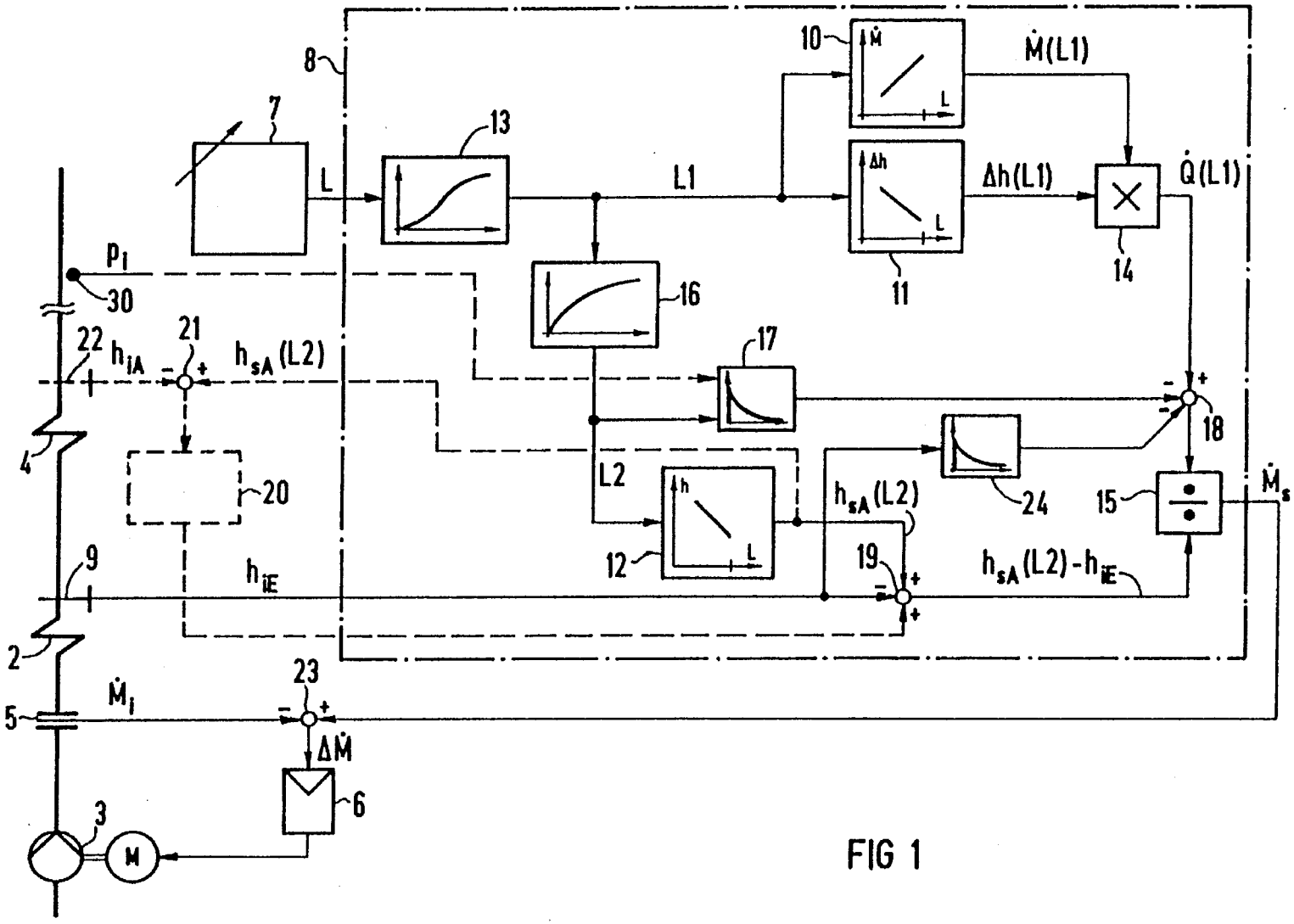
FIG. 1 is a schematic and block circuit diagram of a forced once-through steam generator in accordance with the invention.

Referring now to the figures of the drawing in detail and first, particularly, to FIG. 1 thereof, there is seen a feed-water control system. An associated control of a furnace is disclosed in FIG. 6 of the publication entitled: "VGB Kraftwerkstechnik 65" mentioned above.

The forced once-through steam generator shown in FIG. 1 has a feed-water preheating surface (economizer heating surface) 2 which is situated in a non-illustrated gas passage. In terms of flow, a feed-water pump 3 is connected upstream of the feed-water preheating surface 2 and an evaporator heating surface 4 is connected downstream thereof. Disposed in a feed-water pipe routed from the feed-water pump 3 to the feed-water preheating surface 2 is a measuring device 5 for measuring a feed-water mass flow $M_i$ (=time derivative of the mass) through the feed-water pipe. Furthermore, a measuring device 9 for measuring an actual value $h_{iE}$ of the specific enthalpy of the feed water at an inlet of the evaporator heating surface 4 is provided at the inlet of the evaporator heating surface 4, in the connecting pipe between the feed-water preheating surface 2 and the evaporator heating surface 4.

A very fast controller, and specifically a PI controller 6, is assigned to a drive motor on the feed-water pump 3. An input of the controller 6 receives a control deviation $\Delta M$ of the feed-water mass flow $M_i$ which is measured with the measuring device 5, as a control variable. A device 8 for deriving the setpoint value $\dot{M}_s$ for the feed-water mass flow is assigned to the controller 6. As input variables, the device 8 on one hand receives a value L for the power of the forced once-through steam generator, which is supplied by a setpoint value generator 7, and on the other hand it receives an actual value $h_{iE}$ of the specific enthalpy at the inlet of the evaporator heating surface 4, which is determined by the measuring device 9.

The setpoint value L of the power of the forced once-through steam generator, which constantly varies with time during operation and which is applied to the fuel controller directly in a non-illustrated furnace control circuit, is fed to an input of a first delay element 13 of the device 8. The delay element 13, which is of higher order, for example of second order, supplies a first signal or a delayed first power value L1. The first power value L1 is fed to inputs of first and second function generator units 10 and 11 of a function generator of the device 8. At an output of the function generator unit 10 there appears a value $\dot{M}$(L1) for the feed-water mass flow, and at an output of the function generator unit 11 there appears a value $\Delta h$(L1) for a difference between a specific enthalpy $h_{iA}$ at the outlet of the evaporator heating surface 4 and the specific enthalpy $h_{iE}$ at the inlet of the evaporator heating surface 4. Values $\dot{M}$ and $\Delta h$ as functions of the first power value L1 are stored in the function generator units 10 and 11, respectively. They are determined from steady-state values for $\dot{M}$ and $\Delta h$ which were each measured during a steady-state operation of the forced once-through steam generator and were entered in the function generator units 10 and 11. Possible functions are shown in the small boxes of the units 10 and 11. According to these functions, a function variation which increases or decreases, respectively, in an essentially proportional manner is provided in each case in the range from 35% to 100% (=full load).

The output variables $\dot{M}$(L1) and $\Delta h$(L1) of the function generator units 10 and 11 are multiplied by one another in a multiplication element 14 of the function generator of the device 8. A product value $\dot{Q}$(L1) which is obtained corresponds to a heat flow into the evaporator heating surface 4 at the power value L1. The variable $\dot{Q}$(L1) is entered in a dividing element 15 as a numerator.

A denominator which is entered in the dividing element 15 is a difference that is formed by a summing element 19, between a setpoint value $h_{sA}$(L2) of the specific enthalpy at the outlet of the evaporator heating surface 4 and the actual value $h_{iE}$ of the specific enthalpy at the inlet of the evaporator heating surface 4, which is measured with the aid of the measuring device 9.

The setpoint value $h_{sA}$(L2) is taken from a third function generator unit 12 of the function generator of the device 8. An input value of the function generator unit 12 is produced at an output of a second delay element 16, which in particular is a first-order delay element having an input variable that is the first power value L1 at the output of the first delay element 13. Accordingly, the input value of the third function generator unit 12 is a second power value L2 which is delayed with respect to the first power value L1. The values $h_{sA}$(L2) are stored in the third function generator unit 12 as a function of the second power value L2. They have been determined from values for $h_{sA}$ which have been obtained in each case for a steady-state operation of the once-through steam generator and have been entered in the third function generator unit 12. A possible function is shown in the small box of the unit 12. According to this, a function variation which decreases in an essentially linear manner is provided in the range from 35% to 100% (full load).

The setpoint value $\dot{M}_s=\dot{Q}(L1)/(h_{sA}(L2)-h_{iE})=\Delta h(L1)\times \dot{M}(L1)/(h_{sA}(L2)-h_{iE})$ for the feed-water mass flow can be taken from the output of the dividing element 15 and fed to a summing element 23 which also receives the actual value $M_i$ of the feed-water mass flow into the feed-water preheating surface 2 that is measured by the device 5. The summing element 23 forms the control deviation $\Delta M$ which is fed to the controller 6.

Advantageously, an input of a differentiating element 17 may be located at the output of the second delay element 16. The differentiating element 17 has an output which is connected negatively to a summing element 18. The summing element 18 corrects the value for the heat flow Q(L1) into the evaporator heating surface 4 by the output signal of the differentiating element 17. As is indicated by dotted lines in FIG. 1, an input of the differentiating element 17 may also be applied to a device 30 for measuring the actual value of the pressure $P_i$, downstream of the evaporator heating surface 4 (which may also be downstream of a superheater heating surface that is connected downstream in terms of the flow of the evaporator heating surface 4). A function generator may also be connected between the input of the differentiating element 17 and such a device 30 for measuring the actual value of the pressure $P_i$. The function generator, for example, supplies the saturated steam temperature corresponding to the measured pressure $P_i$ to the differentiating element 17 as output signal.

Advantageously, a further differentiating element 24 may be provided as a function element with a differentiating characteristic. This differentiating element 24 has the actual value $h_{iE}$ that is determined by the measuring device 9, which is the value of the specific enthalpy at the inlet of the evaporator heating surface 4 as an input variable. An output of the differentiating element 24 is also connected negatively to the summing element 18.

In a normal steady-state under-load operation, the forced once-through steam generator is assumed to be in an inertial condition and the setpoint value L for the steam generator power is assumed to be constant. The power values L1 at the output of the delay element 13 and L2 at the output of the delay element 16 are therefore also constant and they have the same value as the setpoint value L.

In this steady-state operation in the inertial condition of the once-through steam generator, $h_{iE}$ corresponds to the steady-state value of the specific enthalpy at the inlet into the evaporator heating surface 4, and the value $\dot{M}_s$ supplied by the device 8 corresponds to the steady-state setpoint value for the feed-water flow into the feed-water preheating surface 2 and, consequently, into the evaporator heating surface 4.

The product $\Delta h(L1)\times\dot{M}(L1)=\Delta h(L)\times\dot{M}(L)$ derived in the multiplication element 14 corresponds to a steady-state value for the heat flow into the evaporator heating surface 4.

In the event of a change in the setpoint value L for the steam generator power at the setpoint value generator 7, a new steady-state value $\dot{Q}(L)$ for the heat flow into the evaporator heating surface 4 is only established with a delay since the furnace of the forced once-through steam generator only follows a change in the setpoint value L of the steam generator power with a delay. This is taken account of by the first delay element 13 of the device 8 (synchronization).

If only because a mass flow requires a finite period of time to flow through the evaporator heating surface 4, the specific enthalpy $h_{iA}$ at the outlet of the evaporator heating surface 4 changes with a further delay in the event of a change in the heat flow into the evaporator heating surface 4, which is taken account of by the second delay element 16 of the device 8.

Taking account of the specific enthalpy $h_{iE}$ measured at the inlet into the evaporator heating surface 4 in deriving the setpoint value $\dot{M}_s$ for the feed-water mass flow makes allowance, in particular, for the behavior over time of the heating of the feed water outside the forced once-through steam generator.

On one hand, the differentiating element 17 reduces the setpoint value $\dot{M}_s$ for the feed-water flow by a suitable correction value for as long as the power value L2 increases over time and the heating of the metal masses of the evaporator heating surface 4 reduces the heat flow which enters the mass flow in the evaporator heating surface 4. On the other hand, the differentiating element 17 increases the setpoint value $\dot{M}_s$ by a suitable correction value for as long as the power value L2 decreases over time and the cooling of the metal masses of the evaporator heating surface 4 increases the heat flow which enters the mass flow in the evaporator heating surface 4.

The output of the differentiating element 17 may also be connected positively (possibly through a scaling element) to the other summing element 19.

On one hand, the differentiating element 24 reduces the setpoint value $\dot{M}_s$ for the feed-water mass flow into the once-through steam generator by a correction value for as long as the actual value $h_{iE}$ of the specific enthalpy at the input of the evaporator heating surface 4 increases. On the other hand, the differentiating element 24 increases the setpoint value $\dot{M}_s$ by a correction value for as long as the actual value $h_{iE}$ decreases with time. The output of the differentiating element 24 may also be connected positively (possibly through a scaling element) to the summing element 19.

The differentiating element 24 may be a pure function element with a differentiating characteristic. However, it may also include additional computing elements which modify the differentiating characteristic.

Figure 2:
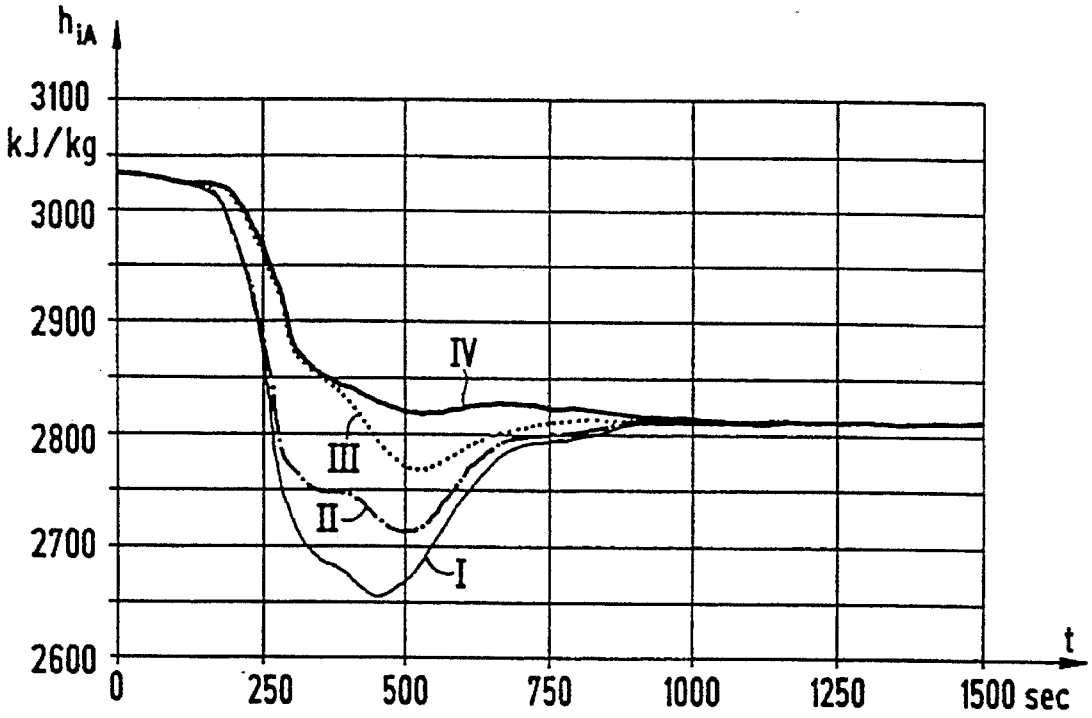
FIGS. 2 and 3 are diagrams which show a variation over time of a specific enthalpy at an outlet of an evaporator heating surface of the forced once-through steam generator shown in FIG. 1.

FIG. 2 shows a variation (series of curves I to IV) of four specific enthalpies $h_{iA}$ in kJ/kg at the outlet of the evaporator heating surface 4 as a function of time t, which were determined for a forced once-through steam generator in the case of a ramp-type change in the setpoint value L for the power of the steam generator from 50% to 100% within 200 seconds. With regard to FIG. 3, similar remarks apply to a variation over time (series of curves I to IV) of the four specific enthalpies $h_{iA}$ in kJ/kg, which are based on a ramp-type change in the setpoint value L of the power of the forced once-through steam generator from 100% to 50% within 200 seconds.

Figure 3:
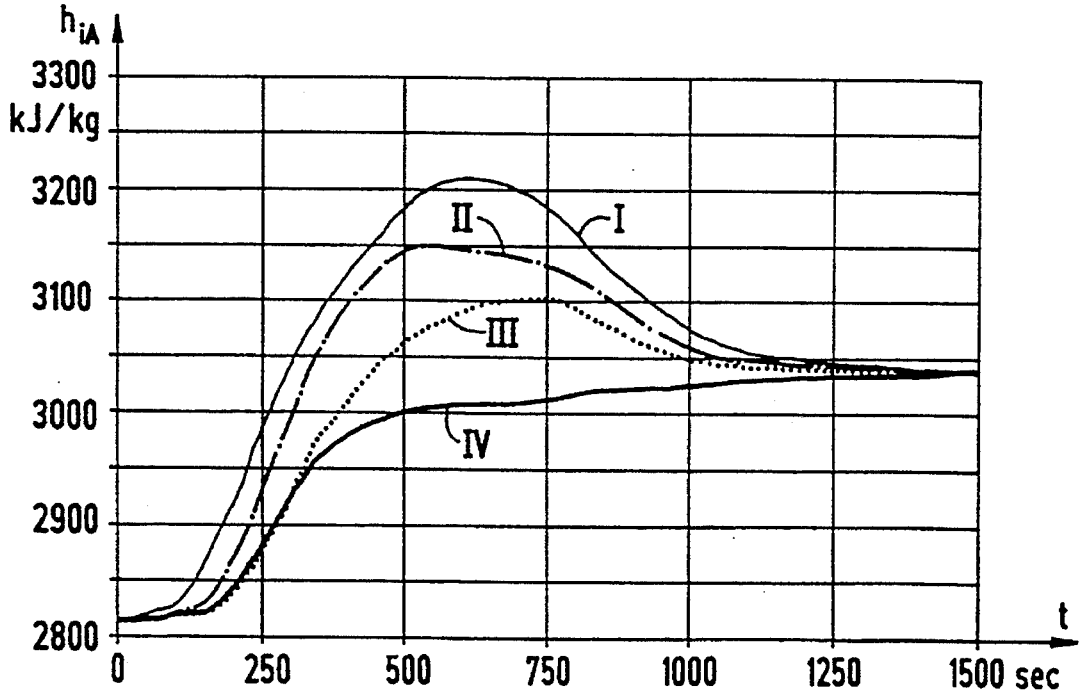

The series of curves I in FIGS. 2 and 3 apply to the case where the power value $\dot{M}(L1)$ of the function generator unit 10 is the uncorrected setpoint value $\dot{M}_s$ for the controller 6. The series of curves II apply to the case where the differentiating elements 17 and 24 in the circuit shown in FIG. 1 are absent, while the series of curves III apply to the circuit shown in FIG. 1, but without the differentiating element 24. The series of curves IV apply to the circuit shown in FIG. 1. The diagrams shown in FIG. 2 and 3 show that the complete circuit shown in FIG. 1 having the series of curves IV is the most beneficial if it is important to avoid an overshoot of the specific enthalpy $h_{iA}$ at the outlet of the evaporator heating surface 4 as completely as possible.

FIG. 1 also shows an enthalpy correction controller 20 in dotted lines, having an input which is connected to an output of a summing element 21. The setpoint value $h_{sA}(L2)$ supplied at the output of the third function generator unit 12 is fed positively to the summing element 21 and the actual value $h_{iA}$ of the specific enthalpy at the outlet of the evaporator heating surface 4 is fed to the summing element 21 negatively. The actual value $h_{iA}$ is measured by a measuring device 22 situated in the outlet pipe of the evaporator heating surface 4. The correction signal at the controller output is fed positively to the summing element 19 of the device 8.

The enthalpy correction controller 20 advantageously corrects the setpoint value $\dot{M}_s$ of the feed-water flow into the forced once-through steam generator. This occurs if the measured actual value $h_{iA}$ of the specific enthalpy at the outlet of the evaporator heating surface 4 deviates from the setpoint value $h_{sA}(L2)$ for the specific enthalpy at the outlet of the evaporator heating surface 4, which setpoint value is supplied by the third function generator unit 12. The deviation is a consequence of external disturbing effects such as, for example, calorific value variations in the fuel fed to the once-through steam generator or alterations in the fire position in the combustion chamber of the once-through steam generator.

We claim:

1. A forced once-through steam generator, comprising:

an evaporator heating surface having an inlet and an outlet;

a device connected upstream of said evaporator heating surface in terms of flow for setting a feed-water mass flow $\dot{M}$ into said evaporator heating surface;

a control device being associated with said device and having a control variable being the feed-water mass flow $\dot{M}$ and a setpoint value $\dot{M}_s$ for the feed-water mass flow being controlled as a function of a setpoint value L assigned to a steam generator power;

another device associated with said control device for deriving a variable $Q(L1)/(h_{sA}(L2)-h_{iE})$ as the setpoint value $\dot{M}_s$ for the feed-water mass flow, said other device receiving an actual value $h_{iE}$ of a specific enthalpy at said inlet of said evaporator heating surface and the setpoint value L assigned to the steam generator power, as input variables;

a function generator from which a value Q(L1) for a heat flow into said evaporator heating surface is derived by a first power value L1, in accordance with a function of the first power value L1 to be fixedly predetermined;

a setpoint value $h_{sA}(L2)$ for a specific enthalpy at said outlet of said evaporator heating surface being derived by a second power value L2 from said function generator in accordance with a function of the second power value L2 to be fixedly predetermined;

a first delay element delaying the first power value L1 relative to the setpoint value L assigned to the steam generator power; and a second delay element delaying the second power value L2 relative to the first power value L1.

2. The forced once-through steam generator according to claim 1, wherein said second delay element has an output, and said other device for deriving the variable $\dot{M}_s=\dot{Q}(L1)/(h_{sA}(L2)-h_{iE})$ includes a differentiating element having an input receiving the second power value L2 at said output of said second delay element and temporarily reducing the value of the variable derived as the setpoint value $\dot{M}_s$ by a correction value if the second power value L2 at said output of said second delay element rises, and temporarily increasing it by a correction value if the second power value L2 decreases.

3. The forced once-through steam generator according to claim 1, wherein said other device for deriving the variable $\dot{M}_s=\dot{Q}(L1)/(h_{sA}(L2)-h_{iE})$ includes a differentiating element having an input receiving an actual value of a pressure measured downstream of said evaporator heating surface and temporarily reducing the value of the variable derived as the setpoint value $\dot{M}_s$ by a correction value if the actual value of the pressure measured downstream of said evaporator heating surface rises, and temporarily increasing it by a correction value if the actual value of the pressure measured downstream of said evaporator heating surface decreases.

4. The forced once-through steam generator according to claim 1, wherein said other device for deriving the variable $\dot{M}_s=\dot{Q}(L1)/(h_{sA}(L2)-h_{iE})$ includes a functional element having a differentiating characteristic and having an input receiving the actual value $h_{iE}$ of the specific enthalpy at said inlet of said evaporator heating surface, for temporarily reducing the value of the variable derived as the setpoint value $\dot{M}_s$ by a correction value, if the actual value $h_{iE}$ of the specific enthalpy at said inlet of said evaporator heating surface rises, and temporarily increases the value of the variable derived as the setpoint value $\dot{M}_s$ by a correction value if the actual value $h_{iE}$ decreases.

5. The forced once-through steam generator according to claim 1, including an enthalpy correction control having a controller input for receiving the variable $(h_{sA}(L2)-h_{iA})$ as a control deviation and having a controller output for supplying a correction value being added to a difference $(h_{sA}(L2)-h_{iE})$, where $h_{iA}$ is the actual value of the specific enthalpy at said outlet of said evaporator heating surface.

6. The forced once-through steam generator according to claim 1, including a multiplication element, said function generator including a first and a second function generator unit receiving the first power value L1 and supplying output signals (M(L1), Δh(L1) being fed to said multiplication element.

7. The forced once-through steam generator according to claim 6, including a summing element, said function generator including a third function generator unit receiving the second power value L2 and supplying an output signal $(h_{sA}(L2))$ to be fed to said summing element.

8. The forced once-through steam generator according to claim 1, wherein said other device includes a dividing element for deriving the variable $\dot{M}_s$.

9. The forced once-through steam generator according to claim 1, including a measuring device for determining the actual value of the specific enthalpy at least at one of said inlet and said outlet of said evaporator heating surface.

* * * * *

UNITED STATES PATENT AND TRADEMARK OFFICE

CERTIFICATE OF CORRECTION

PATENT NO. : 5,529,021

DATED : June 25, 1996

INVENTOR(S) : Axel Butterlin, et. al.

It is certified that error appears in the above-indentified patent and that said Letters Patent is hereby corrected as shown below:

Title page, Abstract,

Item (57), line 9, "Q(L1)/" should read "$\dot{Q}$(L1)/";

line 11, "Q(L1)" should read "$\dot{Q}$(L1)".

Column 1, line 61, "Q(L1)" should read "$\dot{Q}$(L1)";

line 67, "Q(L1)" should read "$\dot{Q}$(L1)".

Column 7, line 39, "Q(L1)" should read "$\dot{Q}$(L1)";

line 45, "Q(L1)" should read "$\dot{Q}$(L1)".

Signed and Sealed this

Eleventh Day of March, 1997

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO : 5,529,021

DATED : June 25, 1996

INVENTOR(S) : Axel Butterlin et al.

It is certified that error appears in the above-identified patent and that said Letters Patent are hereby corrected as shown below:

Column 2, line 64, "($\dot{M}$ (L1)" should read --$\dot{M}$ (L1)--.

Column 8, line 45, "(M (L1)" should read --$\dot{M}$ (L1)--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*